US005098881A

United States Patent [19]

Hiraishi et al.

[11] Patent Number: 5,098,881

[45] Date of Patent: Mar. 24, 1992

[54] HEAT SENSITIVE RECORDING MATERIAL

[75] Inventors: Shigtetoshi Hiraishi; Susumu Yamanobe, both of Tokyo, Japan

[73] Assignee: Mitsubishi Paper Mills Ltd., Tokyo, Japan

[21] Appl. No.: 715,009

[22] Filed: Jun. 13, 1991

Related U.S. Application Data

[63] Continuation of Ser. No. 420,828, Oct. 12, 1989, abandoned.

[30] Foreign Application Priority Data

Oct. 18, 1988 [JP] Japan ..... 63-263747

[51] Int. Cl.[5] ..... B41M 5/30

[52] U.S. Cl. ..... 503/207; 427/150; 503/209; 503/216; 503/217; 503/218; 503/225

[58] Field of Search ..... 427/150; 503/207, 209, 503/216–218, 225

[56] References Cited

U.S. PATENT DOCUMENTS 4,521,793 4/1985 Kabashima et al. ..... 503/201

4,880,767 11/1989 Hiraishi et al. ..... 503/217

OTHER PUBLICATIONS

Translation of Official Action p. 3934 649.8–45.

*Primary Examiner*—Bruce H. Hess

*Attorney, Agent, or Firm*—Cushman, Darby & Cushman

[57] ABSTRACT

The present invention provides a heat sensitive recording material which comprises an aromatic isocyanate compound, an imino compound which reacts with said aromatic isocyanate compound upon application of heat to form a color and a metallic soap which is pulverized together with said imino compound. Preferably the metallic soap has an average particle diameter of 0.5–2.0 μm. This heat sensitive material is excellent in sensitivity and can form an image or excellent stability.

10 Claims, No Drawings

HEAT SENSITIVE RECORDING MATERIAL

This is a continuation of application No. 07/420,828 filed on Oct. 12, 1989 abandoned.

BACKGROUND OF THE INVENTION

1. Field of the Invention

The present invention relates to a heat sensitive recording material which comprises a support and, provided thereon, a specific heat sensitive recording layer and which is excellent in image storage stability and besides, sensitivity and to a method for producing the material.

2. Related Art

In general, a heat sensitive recording material comprises a support and, provided thereon, a heat sensitive recording layer mainly composed of an electron-donating colorless dye precursor and an electron-accepting color developer and when this is heated by a thermal head, a thermal pen, laser beam, and the like, the colorless dye precursor and the color developer react instantaneously to produce a recorded image. Such is disclosed in Japanese Patent Kokoku Nos. 43-4160 and 45-14039 Such heat sensitive recording materials have the merits that recording can be performed by relatively simple devices, maintenance is easy and no noise is generated and are used in various fields such as recorders for measurement, facsimile, printers, terminals for computers, labels and vending machines for tickets, etc.

Such heat sensitive recording materials which utilize electron-donating colorless dye precursor and electron-accepting color developer have various excellent properties that they have good appearance and are good to the touch and can yield high coloring density and various hue, but they suffer from the problems that if colored portion (recorded image portion) contacts with plastic articles such as polyvinyl chloride, the portion disappears due to plastisizer or additives contained in the plastics, or if the portion contacts with chemicals contained in foods or cosmetics, it easily disappears or the portion is readily discolored upon exposure to light for a short period, namely, they are inferior in storage stability of record. Owing to these problems, they are limited in use and improvements on this point has been much demanded.

Further, recently, high-speed printing apparatuses which can perform printing in a short time has been developed and heat sensitive recording materials which have excellent heat responsivity and high sensitivity so that images of sufficient color density can be obtained with low energy have been demanded.

As heat sensitive recording materials which can provide recorded images of high storage stability by the reaction of two components upon heating, Japanese Patent Kokai Nos. 58-38733, 58-54085, 58-104959, 58-149388, 59-115887, and 59-115888 and U.S. Pat. No. 4,521,793 disclose heat sensitive recording materials using imino compound and isocyanate compound as the two components.

These heat sensitive recording materials are superior in storage stability, but are inferior in heat responsivity and are difficult to record image of sufficient density by a high-speed printing apparatus.

SUMMARY OF THE INVENTION

As a result of intensive research conducted by the inventors for obtaining heat sensitive recording material excellent in image storage stability, superior in heat responsivity and high in sensitivity, it has been found that in case of using a heat sensitive recording medium comprising an aromatic isocyanate compound and an imino compound which forms color by reacting with the aromatic isocyanate compound upon application of heat, the desired heat sensitive recording material can be obtained by using metallic soap of 0.5–2.0 μm in average particle diameter which can be obtained by pulverizing simultaneously said imino compound and metallic soap.

DETAILED DESCRIPTION OF PREFERRED EMBODIMENTS

The metallic soaps used in the present invention are metallic salts of fatty acids, resin acids, naphthenic acid, and the like. The acids include, for example, caproic acid, caprylic acid, capric acid, lauric acid, myristic acid, palmitic acid, stearic acid, behenic acid, 12-hydroxystearic acid, ricinolic acid, lanolic acid, oleic acid, abietic acid, neoabietic acid, d-pimaric acid, benzoic acid, cinnamic acid, p-hydroxycinnamic acid, and polymethylenecarboxylic acid. The metals include, for example, aluminum, manganese, cobalt, lead, calcium, iron, tin, magnesium, copper, zinc and nickel.

Preferred are metallic salts of aliphatic or alicyclic carboxylic acids with aluminum, zinc, tin, magnesium or calcium and especially preferred are zinc salts such as zinc stearate.

When the metallic soap mentioned above and the imino compound which is one of color forming components are simultaneously pulverized, sensitivity is markedly enhanced than when each of them is individually pulverized. One reason therefor is considered that imino group of the imino compound and metal partially coordinate with each other at the time of pulverization, thereby to accelerate the reaction of the imino compound with the aromatic isocyanate compound which is another color forming component. Moreover, when metallic soap alone is pulverized, the average particle diameter of the metallic soap can be at most about 5–10 μm and thus effect due to pulverization cannot be ignored.

The "average particle diameter" used here means 50% particle diameter when measured by a microtrack grading analyzer.

The metallic soap is used in an amount of 10–300% by weight, preferably 30–200% by weight of the imino compound.

The aromatic isocyanate compounds used in the present invention mean colorless or light-colored aromatic isocyanate compounds or hetrocyclic isocyanate compounds which are solid at room temperature and include those which are disclosed in U.S. Pat. No. 4,521,793. For example, at least one of the following is used.

2,6-dichlorophenyl isocyanate, p-chlorophenyl isocyanate, 1,3-phenylene diisocyanate, 1,4-phenylene diisocyanate, 1,3-dimethylbenzene-4,6-diisocyanate, 1,4-dimethylbenzene-2,5-diisocyanate, 1-methoxybenzene-2,4-diisocyanate, 1-methoxbenzene-2,5-diisocyanate, 1-ethoxybenzene-2,4-diisocyanate, 2,5-dimethoxybenzene-1,4-diisocyanate, 2,5-diethoxybenzene-1,4-diisocyanate, 2,5-dibutoxybenzene-1,4-diisocyanate, azobenzene-4,4'-diisocyanate, diphenyl ether-4,4'-diisocyanate, naphthalene-1,4-diisocyanate, naphthalene-1,5-diisocyanate, naphthalene-2,6-diisocyanate, naphthalene-2,7-diisocyanate, 3,3'-dimethyl-biphenyl- 4,4'-diisocyanate, 3,3'-dimethoxybiphenyl-4,4'-diisocyanate, diphenylmethane-4,4'-diisocyanate, diphenyldimethylmethane-4,4'-diisocyanate, benzophenone-3,3'-diisocyanate, fluorene-2,7-diisocyanate, anthraquinone-2,6-diisocyanate, 9-ethylcarbazole-3,6-diisocyanate, pyrene-3,8-diisocyanate, naphthalene-1,3,7-triisocyanate, biphenyl-2,4,4'-triisocyanate, 4,4',4''-triisocyanate-2,5-dimethoxytriphenylamine, p-dimethylaminophenyl isocyanate, and tris(4-phenylisocyanato) thiophosphate. If necessary, these isocyanates may be used in the form of so-called blocked isocyanates which are addition compounds with phenols, lactams, oximes, etc. and furthermore may be used in the form of dimers of diisocyanates such as dimer of 1-methylbenzene-2,4-diisocyanate and trimers such as isocyanurates. Besides, they may be used as polyisocyanates which are adducts with various polyols.

The imino compounds used in the present invention are those which have at least one >C=NH group and are represented by the formula $$\phi \quad C{=}NH$$

(wherein represents an aromatic compound residue capable of forming a conjugated system with adjacent C=N) and are those which are colorless or light-colored compounds which are solid at room temperature. Examples thereof are shown below These imino compounds may be used alone or in combination of two or more.

3-iminoisoindolin-1-one, 3-imino-4,5,6,7-tetrachloroisoindolin-1-one, 3-imino-4,5,6,7-tetrabromoisoindolin-1-one, 3-imino-4,5,6,7-tetrafluoroisoindolin-1-one, 3-imino-5,6-dichloroisoindolin-1-one, 3-imino-4,5,7-trichloro-6-methoxy-isoindolin-1-one, 3-imino-4,5,7-trichloro-6-methylmercapto-isoindolin-1-one, 3-imino-6-nitroisoindolin-1-one, 3-imino-isoindolin-1- spiro-dioxolan, 1,1-dimethoxy-3-imino-isoindoline, 1,1-diethoxy-3-imino-4,5,6,7-tetrachloroisoindoline, 1-ethoxy-3-imino-isoindoline, 1,3-diiminoisoindoline, 1,3-diimino-4,5,6,7-tetrachloroisoindoline, 1,3-diimino-6-methoxyisoindoline, 1,3-diimino-6-cyanoisoindoline, 1,3-diimino-4,7-dithia-5,5,6,6-tetrahydroisoindoline, 7-amino-2,3-dimethyl-5-oxopyrrolo[3,4b]pyrazine, 7-amino-2,3-diphenyl-5-oxopyrrolo[3,4b]pyrazine, 1-iminonaphthalic acid imide, 1-iminodiphenic acid imide, 1-phenylimino-3-iminoisoindoline, 1-(3'-chlorophenylimino)-3-iminoisoindoline, 1-(2',5'-dichlorophenylimino)-3-iminoisoindoline, 1-(2',4',5'-trichlorophenylimino)-3-iminoisoindoline, 1-(2'-cyano-4'-nitrophenylimino)-3-iminoisoindoline, 1-(2'-chloro-5'-cyanophenylimino)-3-iminoisoindoline, 1-(2',6'-dichloro-4'-nitrophenylimino)-3-iminoisoindoline, 1-(2',5'-dimethoxyphenylimino)-3-iminoisoindoline, 1-(2',5'-diethoxyphenylimino)-3-iminoisoindoline, 1-(2'-methyl-4'-nitrophenylimino)-3-iminoisoindoline, 1-(5'-chloro-2'-phenoxyphenylimino)-3-iminoisoindoline, 1-(4'-N,N-dimethylaminophenylimino)-3-iminoisoindoline, 1-(3'-N,N-dimethylamino-4'-methoxyphenylimino)-3-iminoisoindoline, 1-(2'-methoxy-5'-N-phenylcarbamoylimino)-3-iminoisoindoline, 1-(2'-chloro-5'-trifluoromethylphenylimino)-3-iminoisoindoline, 1-(5',6'-dichlorobenzothiazothiazolyl-2'-imino)-3-iminoisoindoline, 1-(6'-methylbenzothiazolyl-2'-imino)-3-iminoisoindoline, 1-(4'-phenylaminophenylimino)-3-iminoisoindoline, 1-(p-phenylazophenylimino)-3-iminoisoindoline, 1-(naphthyl-1'-imino)-3-iminoisoindoline, 1-(anthraquinone-1'-imino)-3-iminoisoindoline, 1-(5'-chloroanthraquinone-1'-imino)-3-iminoisoindoline, 1-(N-ethylcarbazolyl-1'-imino)-3-iminoisoindoline, 1-(naphthoquinone-1'-imino)-3-iminoisoindoline, 1'-(pyridyl-4'-imino)-3-iminoisoindoline, 1-(benzimidazolone-6'-imino)-3-iminoisoindoline, 1-(1'-methylbenzimidazolone-6'-imino)-3-iminoisoindoline, 1-(7'-chlorobenzimidazolone-5'-imino)-3-iminoisoindoline, 1-(benzimidazolyl-2'-imino)-3-iminoisoindoline, 1-(benzimidazolyl-2'-imino)-3-imino-4,5,6,7-tetrachloroisoindoline, 1-(2',4'-dinitrophenylhydrozone)-3-iminoisoindoline, 1-(indazolyl-3'-imino)-3-iminoisoindoline, 1-(indazolyl-3'-imino)-3-imino-4,5,6,7-tetrabromoisoindoline, 1-(indazolyl-3'-imino)-3-imino-4,5,6,7-tetrafluoroisoindoline, 1-(benzimidazolyl-2'-imino)-3-imino-4,5-dithiatetrahydroisoindoline, 1-(4',5'-dicyanoimidazolyl-2'-imino)-3-imino-5,6-dimethyl-4,7-pyradiisoindoline, 1-(cyanobenzoylmethylene)-3-iminoisoindoline, 1-(cyanocarbonamidomethylene)-3-iminoisoindoline, 1-(cyanocarbomethoxymethylene)-3-iminoisoindoline, 1-(cyanocarboethoxymethylene)-3-iminoisoindoline, 1-(cyano-N-phenylcarbamoylmethylene)-3-iminoisoindoline, 1-[cyano-N-(3'-methylphenyl)carbamoylmethylene]-3-iminoisoindoline, 1-[cyano-N-(4'-chlorophenyl)-carbamoylmethylene]-3-iminoisoindoline, 1-[cyano-N-(4'-methoxyphenyl)-carbamoylmethylene]-3-iminoisoindoline, 1-[cyano-N-(3'-chloro-4'-methylphenyl)carbamoylmethylene]-3-iminoisoindoline, 1-(cyano-p-nitrophenylmethylene)-3-iminoisoinoline, 1-(dicyanomethylene)-3-iminoisoindoline, 1-(cyano-1', 2', 4'-triazolyl-(3')-carbamoylmethylene)-3-iminoisoindoline 1-(cyanothiazoyl-(2'-carbamoylmethylene)-3-iminoisoindoline, 1-(cyanobenzimidazolyl-(2')-carbamoylmethylene)-3-iminoisoindoline, 1-(cyanobenzothiazolyl(2')-carbamoylmethylene)-3-iminoisoindoline, 1-[(cyanobenzimidazolyl-2')-methylene]-3-iminoisoindoline, 1-[(cyanobenzimidazolyl-2')-methylene]-3-imino-4,5,6,7-tetrachloroisoindoline, 1-[(cyanobenzimidazolyl-2')-methylene]-3-imino-5-methoxyisoindoline, 1-[(cyano-benzimidazolyl-2')-methylene]-3-imino-6-chloroisoindoline, 1-[(1'-phenyl-3'-methyl-5-oxo)-pyrazolidene-4']-3-iminoisoindoline, 1-[(cyanobenzimidazolyl-2')-methylene]-3-imino-4,7-dithiatetrahydroisoindoline, 1-[(cyanobenzimidazolyl-2')-methylene]-3-imino-5,6-dimethyl-4,7-pyradiisoindoline, 1-[(1'-methyl-3'-n-butyl)-barbituric acid-5']-3-iminoisoindoline, 3-imino-1-sulfobenzoic acid imide, 3-imino-1-sulfo-6-chlorobenzoic acid imide, 3-imino-1-sulfo-5,6-dichlorobenzoic acid imide, 3-imino-1-sulfo-4,5,6,7-tetrachlorobenzoic acid imide, 3-imino-1-sulfo-4,5,6,7-tetrabromobenzoic acid imide, 3-imino-1-sulfo-4,5,6,7-tetrafluorobenzoic acid imide, 3-imino-1-sulfo-6-nitrobenzoic acid imide, 3-imino-1-sulfo-6-methoxybenzoic acid imide, 3-imino-1-sulfo-4,5,7-trichloro-6-methylmercaptobenzoic acid imide, 3-imino-1-sulfonaphthoic acid imide, 3-imino-1-sulfo-5-bromonaphthoic acid imide, and 3-imino-2-methyl-4,5,6,7-tetrachloroisoindoline-1-one.

The heat sensitive recording material of the present invention may contain a heat fusible substance for improving heat responsivity. In this case, the substance preferably has a melting point of 60°-180° C., more preferably 80°-140° C.

As examples of the heat fusible substance, mention may be made of benzyl p-benzyloxybenzoate, stearic acid amide, palmitic acid amide, N-methylolstearic acid amide, β-naphthylbenzyl ether, N-stearylurea, N.N'- distearylurea, phenyl β-naphthoate, phenyl 1-hydroxy-2-naphthoate, β-naphthol(p-methylbenzyl) ether, 1,4-dimethoxynaphthalene, 1-methoxy-4-benzyloxynaphthalene, N-stearoylurea, 4-benzylbiphenyl, 1,2-di(m-methylphenoxy)ethane, 1-phenoxy-2-(4-chlorophenoxy)ethane, 1,4-butanediolphenyl ether, and dimethyl terephthalate.

The heat fusible substance may be used alone or in combination of two or more and preferably is used in an amount of 10–300%, more preferably 20–250% by weight of the aromatic isocyanate compound.

The heat sensitive recording material of the present invention can further contain aniline derivatives having at least one amino group disclosed in the inventors' international patent application PCT/JP81/00300 which are further effective for preventing the background from fogging As examples of these compounds, mention may be made of methyl p-aminobenzoate, ethyl p-aminobenzoate, n-propyl p-aminobenzoate, iso-propyl p-aminobenzoate, butyl p-aminobenzoate, dodecyl p-aminobenzoate, benzyl p-aminobenzoate, o-aminobenzophenone, m-aminoacetophenone, p-aminoacetophenone, m-aminobenzamide, o-aminobenzamide, p-aminobenzamide, p-amino-N-methylbenzamide, 3-amino-4-methylbenzamide, 3-amino-4-methoxybenzamide, 3-amino-4-chlorobenzamide, p-(N-phenylcarbamoyl)aniline, p-[N-(4-chlorophenyl)carbamoyl]aniline, p-[N-(4-aminophenyl)carbamoyl]aniline, 2-methoxy-5-(N-phenylcarbamoyl)aniline, 2-methoxy-5-[N-(2'-methyl-3'-chlorophenyl)carbamoyl]aniline, 2-methoxy-5-[N-(2'-chlorophenyl)carbamoyl]aniline, 5-acetylamino-2-methoxyaniline, 4-acetylaminoaniline, 4-(N-methyl-N-acetylamino)aniline, 2,5-diethoxy-4-(N-benzoylamino)aniline, 2,5-dimethoxy-4-(N-benzoylamino)aniline, 2-methoxy-4-(N-benzoylamino)-5-methylaniline, 4-sulfamoylaniline, 3-sulfamoylaniline, 2-(N-ethyl-N-phenylaminosulfonyl)aniline, 4-dimethylaminosulfonylaniline, 4-diethylaminosulfonylaniline, sulfathiazole, 4-aminodiphenylsulfone, 2-chloro-5-N-phenylsulfamoylaniline, 2-methoxy-5-N,N-diethylsulfamoylaniline, 2,5-dimethoxy-4-N-phenylsulfamoylaniline, 2-methoxy-5-benzylsulfonylaniline, 2-phenoxysulfonylaniline, 2-(2'-chlorophenoxy)sulfonylaniline, 3-anilinosulfonyl-4-methylaniline, bis[4-(m-aminophenoxy)phenyl]sulfone, bis[4-(p-aminophenoxy)phenyl]sulfone, bis[3-methyl-4-(p-aminophenoxy)phenyl]sulfone, 3,3'-dimethoxy-4,4'-diaminobiphenyl, 3,3'-dimethyl-4,4'-diaminobiphenyl, 2,2'-dimethyl-4,4'-diaminobiphenyl, 2,2'-dichloro-4,4'-diamino-5,5'-dimethoxybiphenyl, 2,2',5,5'-tetrachloro-4,4'-diaminobiphenyl, o-tolidinesulfone, 2,4'-diaminobiphenyl, 2,2'-diaminobiphenyl, 4,4'-diaminobiphenyl, 2,2'-dichloro-4,4'-diaminobiphenyl, 3,3'-dichloro-4,4'-diaminobiphenyl, 2,2'-dimethyl-4,4'-diaminobiphenyl, 4,4'-thiodianiline, 2,2'-dithiodianiline, 4,4'-dithiodianiline, 4,4'-diaminodiphenyl ether, 3,3'-diaminodiphenyl ether, 3,4'-diaminodiphenyl ether, 4,4'-diaminodiphenylmethane, 3,4'-diaminodiphenylmethane, bis(3-amino-4-chlorophenyl)sulfone, bis(3,4-diaminophenyl)sulfone, bis(4-aminophenyl)sulfone, bis(3-aminophenyl)sulfone, 3,4'-diaminodiphenylsulfone, 3,3'-diaminodiphenylmethane, 4,4'-ethylenedianiline, 4,4'-diamino-2,2'-dimethylbibenzyl, 4,4'-diamino-3,3'-dichlorodiphenylmethane, 3,3'-diaminobenzophenone, 4,4'-diaminobenzophenone, 1,4-bis(4-aminophenoxy)benzene, 1,3-bis(4-aminophenoxy)benzene, 1,3-bis(3-aminophenoxy)benzene, 9,9-bis(4-aminophenyl)fluoran, 2,2-bis(4-aminophenoxyphenyl)propane, 4,4'-bis(4-aminophenoxy)diphenyl, 3,3',4,4'-tetraaminodiphenyl ether, 3,3',4,4'-tetraaminodiphenylsulfone, and 3,3',4,4'-tetraaminobenzophenone.

The codispersion of imino compound and metallic soap is prepared by mixing them and pulverizing the mixture to a particle diameter of less than 5 μ, preferably 0.5–2.0 μ in a dispersion midium by a ball mill, sand mill, Dynomill, attritor, colloid mill, or the like. It is also possible to predisperse one or both of the imino compound and the metallic soap, followed by mixing them and pulverizing the mixture to obtain a codispersion. Further, it is also possible to add the above-mentioned heat fusible substance and then carry out pulverization. As the dispersion medium, there may be used an aqueous solution containing a compound having dispersing ability such as water-soluble high molecular compound, high molecular emulsion or surface active agent, for example, polyvinyl alcohol, modified polyvinyl alcohol or hydroxyethylcellulose.

The thus obtained codispersion, a dispersion of aromatic isocyanate compound and a binder are mixed to obtain a heat sensitive coating solution The coating solution is coated on a support by a coating method such as air knife coating, blade coating, curtain, or the like to form a heat sensitive recording layer, whereby the heat sensitive recording material of the present invention can be obtained.

The heat sensitive recording material of the present invention comprises a support and, provided thereon, a heat sensitive recording layer which forms color upon heating as mentioned above As the support, paper is mainly used, but various non-woven fabrics, synthetic resin films, laminated papers, synthetic papers, metal foils and composite sheets comprising combinations of them may be used depending on use. The heat sensitive recording layer may comprise a single layer or a plurality of layers of multi-layer construction. In the case of multi-layer construction, an interlayer may be provided between layers Furthermore, a protective layer may be provided on the heat sensitive recording layer. This recording layer may be formed by coating a mixture of an aqueous dispersion of each color forming component finely powdered and a binder on a support and drying the coat. In this case, each color forming component may be contained in one separate layer and thus, multi-layer construction may be formed.

The binder includes, for example, watersoluble binders such as starches, hydroxyethylcellulose, methylcellulose, carboxymethylcellulose, gelatin, casein, polyvinyl alcohol, modified polyvinyl alcohol, styrene-maleic anhydride copolymer, and ethylene-maleic anhydride copolymer and latex type water-insoluble binders such as styrene-butadiene copolymer, acrylonitrile-butadiene copolymer and methyl acrylatebutadiene copolymer.

The heat sensitive recording layer may further contain pigments such as diatomaceous earth, talc, kaolin, calcined kaolin, calcium carbonate, magnesium carbonate, titanium oxide, zinc oxide, silicon oxide, aluminum hydroxide, and urea-formalin resin, besides higher fatty acid metallic salts such as zinc stearate and calcium stearate and waxes such as paraffin, paraffin oxide, polyethylene, polyethylene oxide, stearic acid amide, and castor wax for prevention of wear of head and sticking, dispersants such as sodium dioctylsulfosuccinate, ultraviolet absorbers of benzophenone type and benzotriazole type, surface active agents and fluorescent dyes.

The present invention will be explained in more detail by the following examples

EXAMPLE 1

150 g of 1,3-diimino-4,5,6,7-tetrachloroisoindoline as an imino compound and 150 g of zinc stearate as a metallic soap were codispersed together with 700 g of 8.5% aqueous polyvinyl alcohol solution by a sand mill to obtain a codispersion. Separately, 100 g of 4,4',4''-triisocyanato-2,5-dimethoxytriphenylamine was similarly dispersed together with 400 g of 2.5% aqueous polyvinyl alcohol solution to obtain a dis-persion. Furthermore, 200 g of 2-benzyloxynaphthalene was similarly dispersed together with 800 g of 2.5% aqueous polyvinyl alcohol solution to obtain a dispersion. Average particle diameter of the zinc stearate was 0.8 μm. These three dispersions were well mixed and stirred and then thereto were added 1250 g of 40% dispersion of calcium carbonate and 1500 g of aqueous polyvinyl alcohol solution, followed by well stirring to obtain a coating solution This coating solution was coated on a base paper of 50 g/m$^2$ (basis weight) at coverage of 5.1 g/m$^2$ (dry solid content) and supercalendered to obtain a heat sensitive recording material.

EXAMPLE 2

A heat sensitive recording material was produced in the same manner as in Example 1 except that p-benzylbiphenyl was used in place of 2-benzyloxynaphthalene.

COMPARATIVE EXAMPLE 1

A heat sensitive recording material was produced in the same manner as in Example 1 except that a dispersion prepared by dispersing 150 g of 1,3-diimino-4,5,6,7-tetrachloroisoindoline together with 350 g of 8.5% aqueous polyvinyl alcohol solution by a sand mill and a dispersion prepared by dispersing 150 g of zinc stearate together with 350 g of 8.5% aqueous polyvinyl alcohol solution by a sand mill were used in place of the codispersion of 1,3-diimino-4,5,6,7-tetrachloroisoindoline and zinc stearate.

COMPARATIVE EXAMPLE 2

A heat sensitive recording material was obtained in the same manner as in Example 2 except that the dispersion of 1,3-diimino-4,5,6,7-tetrachloroisoindoline and the dispersion of zinc stearate used in Comparative Example 1 were used in place of the codispertion of 1,3-diimino-4,5,6,7-tetrachloroisoindoline and zinc stearate.

(Test)

The heat sensitive recording materials obtained in Examples 1 and 2 and Comparative Examples 1 and 2 were respectively printed by heat sensitive facsimile printing tester with applied pulse under conditions of 1.0 msec and 1.4 msec and applied voltage of 11.00 volts and densities of the obtained color image and non-image area were measured by Macbeth RD918.

The results are shown in Table 1.

TABLE 1

| | Color density | | Density of |
|---|---|---|---|
| | 1.0 msec | 1.4 msec | non-image |
| Example 1 | 0.57 | 0.92 | 0.05 |
| Comparative Example 1 | 0.41 | 0.85 | 0.05 |
| Example 2 | 0.53 | 0.91 | 0.05 |
| Comparative Example 2 | 0.34 | 0.79 | 0.05 |

Heat sensitive recording materials excellent in image storage stability and heat responsivity were able to be obtained by using the codispersion according to the present invention.

What is claimed is:

1. A heat sensitive recording material which comprises a support, an aromatic isocyanate compound, an imino compound which reacts with said aromatic isocyanate compound upon application of heat to form a color and a metallic soap, said and said metallic soap having been pulverized simultaneously and applied to said support as a condispersion.

2. A heat sensitive recording material according to claim 1, wherein average particle diameter of the pulverized metallic soap is 0.5–2.0 μm.

3. A heat sensitive recording material according to claim 1, wherein the content of the metallic soap is 10–300% by weight of the imino compound.

4. A heat sensitive recording material according to claim 1, wherein the metallic soap is a zinc salt of an aliphatic or alicyclic carboxylic acid.

5. A heat sensitive recording material according to claim 1, wherein the metallic soap is a zinc salt of stearic acid.

6. A method for producing a heat sensitive recording material which comprises (a) preparing a codispersion of an imino compound and a metallic soap by simultaneously pulverizing them and (b) coating a support with said codispersion and an aromatic compound which reacts with said imino compound upon application of heat to form a color.

7. A method according to claim 6, wherein average particle diameter of the pulverized metallic soap is 0.5–2.0 μm.

8. A method according to claim 6, wherein amount of the metallic soap is 10–300% by weight of the imino compound.

9. A method according to claim 8, wherein the metallic soap is a zinc salt of stearic acid.

10. A method according to claim 6, wherein the metallic soap is a zinc salt of an aliphatic or alicyclic carboxylic acid.

* * * * *